US007448659B1

(12) United States Patent
Auseklis

(10) Patent No.: US 7,448,659 B1
(45) Date of Patent: Nov. 11, 2008

(54) PET DEBRIS SCOOPER SYSTEMS

(76) Inventor: Alexander E. Auseklis, 2269 Chestnut St., #194, San Francisco, CA (US) 94123

( * ) Notice: Subject to any disclaimer, the term of this patent is extended or adjusted under 35 U.S.C. 154(b) by 364 days.

(21) Appl. No.: 11/343,449

(22) Filed: Jan. 30, 2006

Related U.S. Application Data

(60) Provisional application No. 60/702,784, filed on Jul. 26, 2005.

(51) Int. Cl.
*A01K 29/00* (2006.01)
*E01H 1/12* (2006.01)

(52) U.S. Cl. ..... 294/1.4

(58) Field of Classification Search ..... 294/1.3, 294/1.4, 1.5; 15/104.8, 257.1, 257.6; 119/161
See application file for complete search history.

(56) References Cited

U.S. PATENT DOCUMENTS 3,738,697 A 6/1973 Kahan
3,971,503 A 7/1976 Allan et al.
3,984,139 A 10/1976 Battaglia
3,986,744 A 10/1976 Krogstad et al.
4,010,970 A 3/1977 Campbell
4,012,067 A 3/1977 Travis
4,014,584 A 3/1977 Bau et al.
4,017,015 A 4/1977 Jefferson
4,021,994 A 5/1977 Mainprice
4,056,278 A 11/1977 Bau et al.
4,097,082 A 6/1978 Orofino
4,103,952 A 8/1978 Thompson
4,103,953 A 8/1978 Lachance
4,119,337 A * 10/1978 Sherhandt ..... 294/1.4
4,121,866 A 10/1978 Schall et al.
4,146,259 A 3/1979 Schultz
4,179,145 A 12/1979 Shinsako
4,186,955 A 2/1980 Campbell
4,194,777 A 3/1980 Carns
4,201,409 A 5/1980 O'Hara
4,205,869 A 6/1980 Mathis
4,215,886 A 8/1980 Naderi et al.
4,221,415 A 9/1980 Ganz
4,225,174 A 9/1980 Hennessy et al.
4,230,354 A 10/1980 Claras
4,243,259 A 1/1981 Wright
4,247,139 A * 1/1981 Grieb ..... 294/1.4
4,253,691 A 3/1981 Liu
4,257,635 A 3/1981 Mainprice
4,257,636 A 3/1981 Mainprice
4,316,627 A 2/1982 Solypa
4,323,272 A 4/1982 Fortier
4,335,678 A 6/1982 Garza et al.
4,368,907 A 1/1983 Ross (Continued)

*Primary Examiner*—Dean J Kramer
(74) *Attorney, Agent, or Firm*—Stoneman Volk Patent Group; Martin L. Stoneman; Michael D. Volk, Jr.

(57) ABSTRACT

A system for picking up solid objects, such as pet debris and pet waste, and automatically sealing such pet waste within a disposable liner. The liner is installed on a hand-held scooper device by an automatic applicator. The liners are design specifically for the system and comprise a self-sealing feature adapted to assist in encapsulating the waste. The applicator also functions as a storage holder for the hand-held scoop. A kit comprising the hand-held scoop device, the storage automatic applicator, and disposable liners is also disclosed.

20 Claims, 8 Drawing Sheets

U.S. PATENT DOCUMENTS 4,383,710 A 5/1983 Fehr
4,444,152 A 4/1984 Berardo
4,447,082 A 5/1984 Lindholm
4,458,932 A 7/1984 Resch
4,477,111 A 10/1984 Crooks
4,500,125 A 2/1985 Olson
D279,512 S 7/1985 Schaffer
D283,262 S 4/1986 Kline
4,645,252 A 2/1987 Riley
4,717,186 A 1/1988 Yoshioka
4,718,707 A 1/1988 Greenhut
4,741,565 A 5/1988 Bagg
4,765,666 A 8/1988 Parks
4,776,621 A 10/1988 Streit
D298,369 S 11/1988 Shun et al.
4,854,624 A 8/1989 Baymiller
4,865,371 A 9/1989 Egberg
4,875,729 A 10/1989 Peck
4,896,912 A 1/1990 Parnell
4,900,077 A 2/1990 Beck
4,909,553 A 3/1990 Hantover
4,958,871 A 9/1990 Hemans
4,962,956 A 10/1990 Scriptor
5,033,781 A 7/1991 Flood
5,039,148 A 8/1991 Brautovich
5,054,828 A 10/1991 Hantover
5,167,377 A 12/1992 Chalmers
D334,255 S 3/1993 Nelson
D334,638 S 4/1993 Blackman
5,205,107 A 4/1993 Herink
5,236,237 A 8/1993 Shultz
5,269,575 A 12/1993 Parvaresh
5,280,978 A 1/1994 Bohn
5,282,660 A 2/1994 Halling
5,295,721 A 3/1994 Wu
5,318,330 A 6/1994 Dombrowski
5,320,393 A 6/1994 Cortinas
5,335,952 A 8/1994 Clapper
5,350,208 A 9/1994 Heinrichson
5,355,836 A 10/1994 Vallery
5,360,247 A 11/1994 Vachter
5,370,431 A 12/1994 Henninger et al.
5,382,063 A 1/1995 Wesener et al.
5,386,802 A 2/1995 Hang-Fu
5,394,833 A 3/1995 Glass
5,400,572 A 3/1995 Peck et al.
5,409,279 A 4/1995 Magee
5,410,987 A 5/1995 Simmons
5,476,296 A 12/1995 Gross
5,482,337 A 1/1996 Rose
5,503,442 A 4/1996 Lee
5,540,469 A 7/1996 Albert
5,564,762 A 10/1996 Ring
5,564,763 A 10/1996 Mercurio
5,579,812 A 12/1996 Bigwood
5,580,111 A 12/1996 Bohn
5,584,519 A 12/1996 Myles et al.
5,586,521 A 12/1996 Kelley
5,601,321 A 2/1997 Simon
5,620,220 A 4/1997 Khoshnood
5,624,144 A 4/1997 Roche
5,628,537 A 5/1997 Kiemer
5,634,678 A 6/1997 Bailey
5,661,873 A 9/1997 Karet
5,667,264 A 9/1997 Tanahara
5,671,959 A 9/1997 Tsou
5,713,302 A 2/1998 Walter
5,713,616 A 2/1998 Knudson
5,718,469 A 2/1998 Ockerman
5,725,268 A 3/1998 Besasie et al.
5,738,444 A 4/1998 Lantz et al.
5,741,036 A 4/1998 Ring
5,785,369 A 7/1998 Ridley, Sr. et al.
5,799,993 A 9/1998 Lafferty
5,803,293 A 9/1998 Lovekin
5,829,671 A 11/1998 Hawk
5,860,742 A 1/1999 Faircloth, Jr.
5,865,486 A 2/1999 Bussani
5,868,447 A 2/1999 Clark et al.
5,899,510 A 5/1999 Hayes et al.
5,931,117 A 8/1999 Lantz et al.
5,971,452 A 10/1999 Marymor et al.
D418,261 S 12/1999 Betts et al.
6,003,913 A 12/1999 Flumiani
6,012,748 A 1/2000 Franks
6,030,011 A 2/2000 Layton
6,062,168 A 5/2000 Host et al.
6,082,574 A 7/2000 Johnson
6,086,123 A 7/2000 Sowenski et al.
6,098,569 A 8/2000 Kent et al.
6,102,457 A 8/2000 Smith
6,113,166 A 9/2000 Wynn
6,126,215 A 10/2000 Jahns
6,129,050 A 10/2000 Carbajal
6,135,520 A 10/2000 Miller et al.
6,142,543 A 11/2000 Friberg
6,164,710 A 12/2000 Shibuya
6,170,692 B1 1/2001 Johnston
6,196,601 B1 3/2001 Juntunen, Jr.
6,199,737 B1 3/2001 Ringelstetter
6,202,595 B1 3/2001 Atcravi
6,216,634 B1 4/2001 Kent et al.
6,227,473 B1 5/2001 Arnold
6,237,972 B1 5/2001 Jung
6,257,473 B1 7/2001 Ringelstetter
D446,696 S 8/2001 Allison
6,276,300 B1 8/2001 Lewis, II et al.
6,305,322 B1 * 10/2001 Patel ..... 119/161
6,315,448 B1 11/2001 Thrall
6,332,429 B1 12/2001 Gramlich
6,354,243 B1 3/2002 Lewis, II et al.
6,378,577 B1 4/2002 Piner et al.
6,394,514 B1 5/2002 Kidd
6,439,627 B1 8/2002 Devane
6,478,351 B1 11/2002 Nelson
6,478,465 B1 11/2002 Thrall
6,485,073 B2 11/2002 Harrison
6,554,334 B2 4/2003 Rincon Uribe
6,554,335 B1 4/2003 Kelley et al.
6,588,375 B2 7/2003 Benedetti
6,590,146 B1 7/2003 Mrsny
6,641,188 B2 11/2003 Arceo
D483,159 S 12/2003 Boyd
D485,025 S 1/2004 Edwards et al.
6,702,349 B2 3/2004 Clements
6,832,796 B1 12/2004 Minassians
6,837,187 B2 1/2005 Berardo
6,932,399 B2 8/2005 Fonfrias
2004/0004361 A1 1/2004 Foster et al.
2004/0100108 A1 * 5/2004 Cappellano et al. ..... 294/1.3
2004/0124646 A1 7/2004 Peko
2004/0145196 A1 7/2004 Katz
2005/0111763 A1 5/2005 Jung
2005/0194799 A1 9/2005 Karimi et al.

* cited by examiner

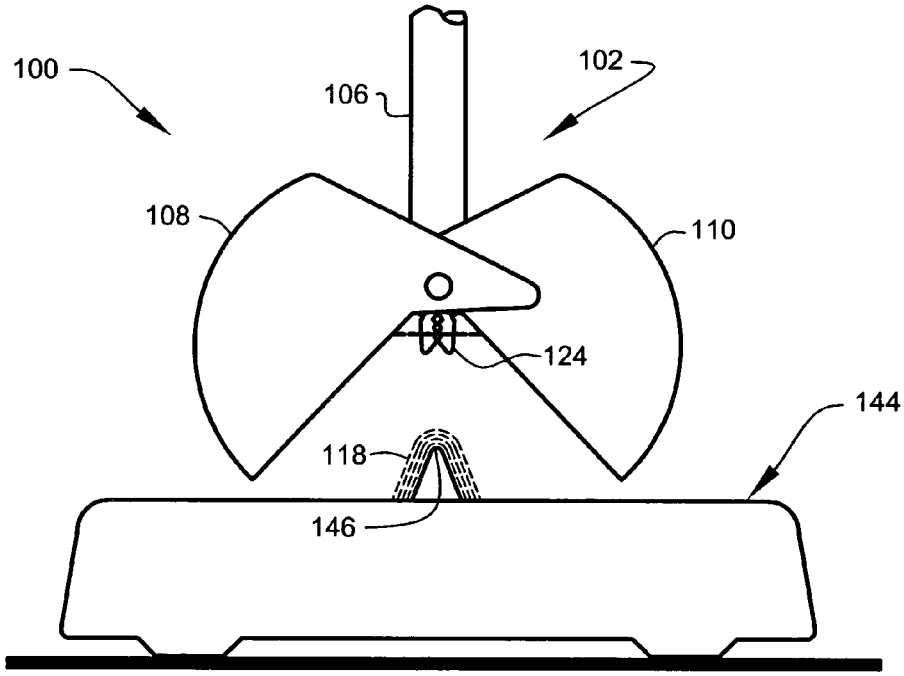
FIG. 7A
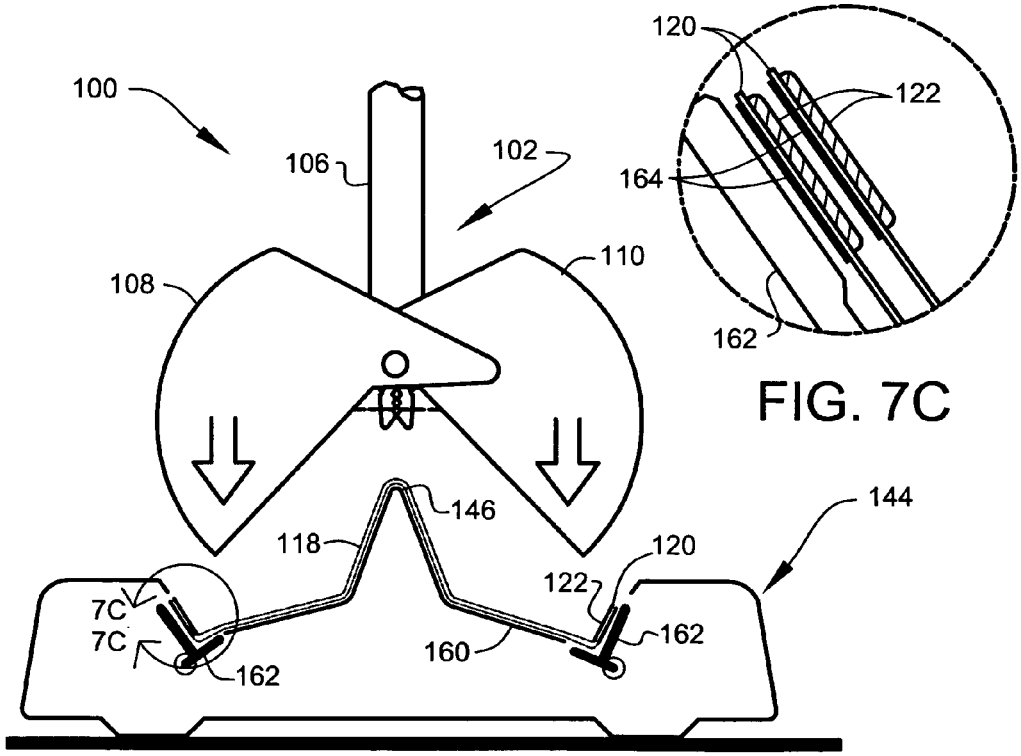
FIG. 7C
FIG. 7B

PET DEBRIS SCOOPER SYSTEMS

CROSS-REFERENCE TO RELATED APPLICATION

The present application is related to and claims priority from prior provisional application Ser. No. 60/702,784, filed Jul. 26, 2005, entitled "A DEVICE FOR PICKING UP, AND SEALING WITHIN A BAG, SOLID OBJECTS, SUCH AS DEBRIS OR WASTE, HEREAFTER CALLED A "SCOOPER", the contents of which are incorporated herein by this reference and are not admitted to be prior art with respect to the present invention by the mention in this cross-reference section.

BACKGROUND

This invention relates to providing a system for improved pet waste collection. More particularly, this invention relates to providing a system for the convenient application of a disposable liner to a pet-debris scooper adapted to collect and seal the pet waste and debris within such liner.

Pet waste left in public areas such as streets and sidewalks creates numerous sanitary problems, particularly in metropolitan areas having high population densities. It has been estimated that there are currently 60 million dogs in the United States alone, many of which residing in such large urban areas. Many municipalities have enacted local ordinances requiring that the pet owner clean up after their pets. Such tasks are unpleasant and often difficult to perform while managing the pet.

Because there are no easy to use and effective products currently available, most dog owners resort to the "bag-in-hand" method. Using a plastic grocery bag, the pet owner hand scoops the pet waste, closes the bag, and disposes of the waste in a trash receptacle. Some longtime dog owners have resigned to this primitive method, but new owners are understandably repulsed by the above-described technique. It is therefore clear that a need exists for devices that provide clean and efficient collection and disposal of pet waste, in a convenient and sanitary fashion.

OBJECTS AND FEATURES OF THE INVENTION

It is the primary object and feature of the present invention to overcome the above-described problems. It is another primary object and feature of the present invention to provide a system for the convenient application of a disposable liner to a portable pet-debris scooper. It is a further object and feature of the present invention to provide such a system that comprises an improved pet-debris scooper apparatus.

It is another object and feature of the present invention to provide a system wherein the applicator of the disposable liner additionally functions as a convenient holder for the pet-debris scooper. It is a further object and feature of the present invention to provide such a system in the form of the consumer kit.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a method related to the collection of at least one pet waste item using at least one hand-holdable grasper comprising the steps of: providing at least one disposable liner adapted to resist the passage of the pet waste; providing at least one applicator adapted to apply such at least one disposable liner to such at least one hand-holdable grasper; loading at least one first at least one disposable liner onto such at least one applicator; loading such at least one hand-holdable grasper onto such at least one applicator, wherein such at least one first at least one disposable liner becomes attached to such at least one hand-holdable grasper; and removing from such at least one applicator, such at least one hand-holdable grasper comprising such at least one first at least one disposable liner.

Moreover, it provides such a waste collection system further comprising the step of grasping the at least one pet waste item with such at least one hand-holdable grasper comprising such at least one first at least one disposable liner, wherein such at least one first at least one disposable liner substantially encapsulates the at least one pet waste item. Additionally, it provides such a waste collection system further comprising the step of releasing such at least one first at least one disposable liner from such at least one hand-holdable grasper, wherein such at least one first at least one disposable liner substantially encapsulates the at least one pet waste item. Also, it provides such a waste collection system further comprising the step of loading such at least one hand-holdable grasper onto such at least one applicator for storage, wherein at least one second at least one disposable liner becomes attached to such at least one hand-holdable grasper.

In accordance with another preferred embodiment hereof, this invention provides a system related to the collection and encapsulation of pet waste within at least one liner comprising at least one membrane substantially impermeable to the pet waste, such system comprising: at least one grasper adapted to grasp the pet waste; at least one holding component adapted to hold such at least one grasper; wherein such at least one holding component comprises at least one holder adapted to hold the at least one liner; wherein such at least one holding component further comprises at least one applicator adapted to apply the at least one liner to such at least one grasper; and wherein such at least one grasper comprises at least one hand grip to assist hand gripping of such at least one grasper during such applying of the at least one liner to such at least one grasper and during such grasping of the pet waste by such at least one grasper.

In addition, it provides such a system further comprising: such at least one liner; wherein such at least one liner comprises at least one membrane substantially impermeable to the pet waste; and wherein such at least one membrane is substantially flexible. And, it provides such a system wherein: such at least one grasper comprises at least one container adapted to contain the pet waste; such at least one container comprises at least one first containment wall and at least one second containment wall; such at least one first containment wall is movably positionable relative to such at least one second containment wall; such at least one first containment wall and at least one second containment wall are together adapted to comprises at least one substantially enclosable interior portion; and such at least one substantially enclosable interior portion is adapted to receive at least one liner portion of such at least one liner.

Further, it provides such a system wherein: such at least one liner comprises at least one releasable adhesive adapted to releasably adhere the at least one liner to such at least one first containment wall and such at least one second containment wall; and such at least one applicator is adapted to assist in adhering such at least one releasable adhesive of such at least one liner to such at least one first containment wall and such at least one second containment wall. Even further, it provides such a system wherein: such at least one grasper further comprises at least one liner retainer adapted to retain such at least one liner portion of such at least one liner; and such at least one liner retainer is positioned substantially within such at least one substantially enclosable interior portion.

Moreover, it provides such a waste collection system, wherein: such at least one liner retainer comprises at least one puller adapted to pull such at least one liner into such at least one substantially enclosable interior portion; and such pulling of such at least one liner into such at least one substantially enclosable interior portion detaches such at least one liner from such at least one first containment wall and such at least one second containment wall. Additionally, it provides such a system, wherein: such at least one liner comprises at least one sealer structured and arranged to seal such at least one liner substantially around the pet waste; wherein such at least one sealer is adapted to be assisted in such sealing of such at least one liner substantially around the pet waste by such pulling of such at least one liner into such at least one substantially enclosable interior portion.

Also, it provides such a system, wherein such at least one sealer comprises at least one contact adhesive. In addition, it provides such a system, wherein such at least one sealer comprises at least one self-sealing material comprising at least one flexible film coated with at least one pressure sensitive adhesive adapted to self-seal by at least one application of mechanical pressure. And, it provides such a system further comprising: at least one releaser adapted to release such at least one liner from such at least one liner retainer; and such at least one releaser is controlled by such pulling of such at least one liner by such at least one puller.

Further, it provides such a system wherein: such at least one hand grip comprises at least one elongated handle adapted to support such at least one first containment wall and such at least one second containment wall; such at least one first containment wall and such at least one second containment wall each comprise at least one generally scoop-shaped member; at least one of such at least one generally scoop-shaped members comprises at least one pivoting coupler adapted to movably join at least one of such at least one generally scoop-shaped members to such at least one elongated handle. Even further, it provides such a system wherein such at least one substantially enclosable interior portion of such at least one container is formable by the positioning of at least one of such at least one generally scoop-shaped members adjacent at least one other such at least one generally scoop-shaped members. Even further, it provides such a system wherein: such at least one liner further comprises at least one removable cover adapted to removably cover such at least one releasable adhesive during storage; and such at least one applicator is adapted to remove such at least one removable cover prior to adherence of such at least one liner to such at least one first containment wall and such at least one second containment wall.

Even further, it provides such a system wherein: such at least one liner further comprises at least one periphery comprising at least one first peripheral side and at least one second peripheral side; such at least one first peripheral side comprises such at least one releasable adhesive; such at least one second peripheral side comprises at least one adhesive resistor adapted to resist adherence of such at least one releasable adhesive; and at least one such at least one liner is stackable over at least one other such at least one liner without adherence between such at least one first peripheral side and such at least one second peripheral side. Even further, it provides such a system wherein such at least one applicator further comprises at least one positional director adapted to positionally direct such at least one liner to at least one retainable position adjacent such at least one liner retainer.

In accordance with another preferred embodiment hereof, this invention provides a kit system related to the collection and encapsulation of pet waste within at least one liner comprising at least one membrane substantially impermeable to the pet waste, such system comprising: at least one grasper adapted to grasp the pet waste wherein such at least one grasper comprises at least one hand grip to assisting hand gripping of such at least one grasper during such grasping of the pet waste by such at least one grasper; at least one holding component adapted to hold such at least one grasper wherein such at least one holding component comprises at least one holder adapted to hold the at least one liner, and wherein such at least one holding component further comprises at least one applicator adapted to apply the at least one liner to such at least one grasper; and at least one set of user instructions for use. Moreover, it provides such a kit system further comprising such at least one liner. Also, it provides such a kit system further comprising at least one packing container adapted to contain such at least one grasper, such at least one holding component, and such at least one set of user instructions for use.

BRIEF DESCRIPTION OF THE DRAWINGS

FIG. 7A shows side view depicting a disposable-liner dispenser according to a preferred embodiment of the present invention;

FIG. 7B shows a diagrammatic sectional view depicting the internal functional components of the disposable-liner dispenser of FIG. 7A;

FIG. 7C shows the detail view 7C-7C of FIG. 7B illustrating an adhesive strip arrangement on a peripheral edge of the disposable liner;

DETAILED DESCRIPTION OF THE BEST MODES AND PREFERRED EMBODIMENTS OF THE INVENTION

Figure 1:
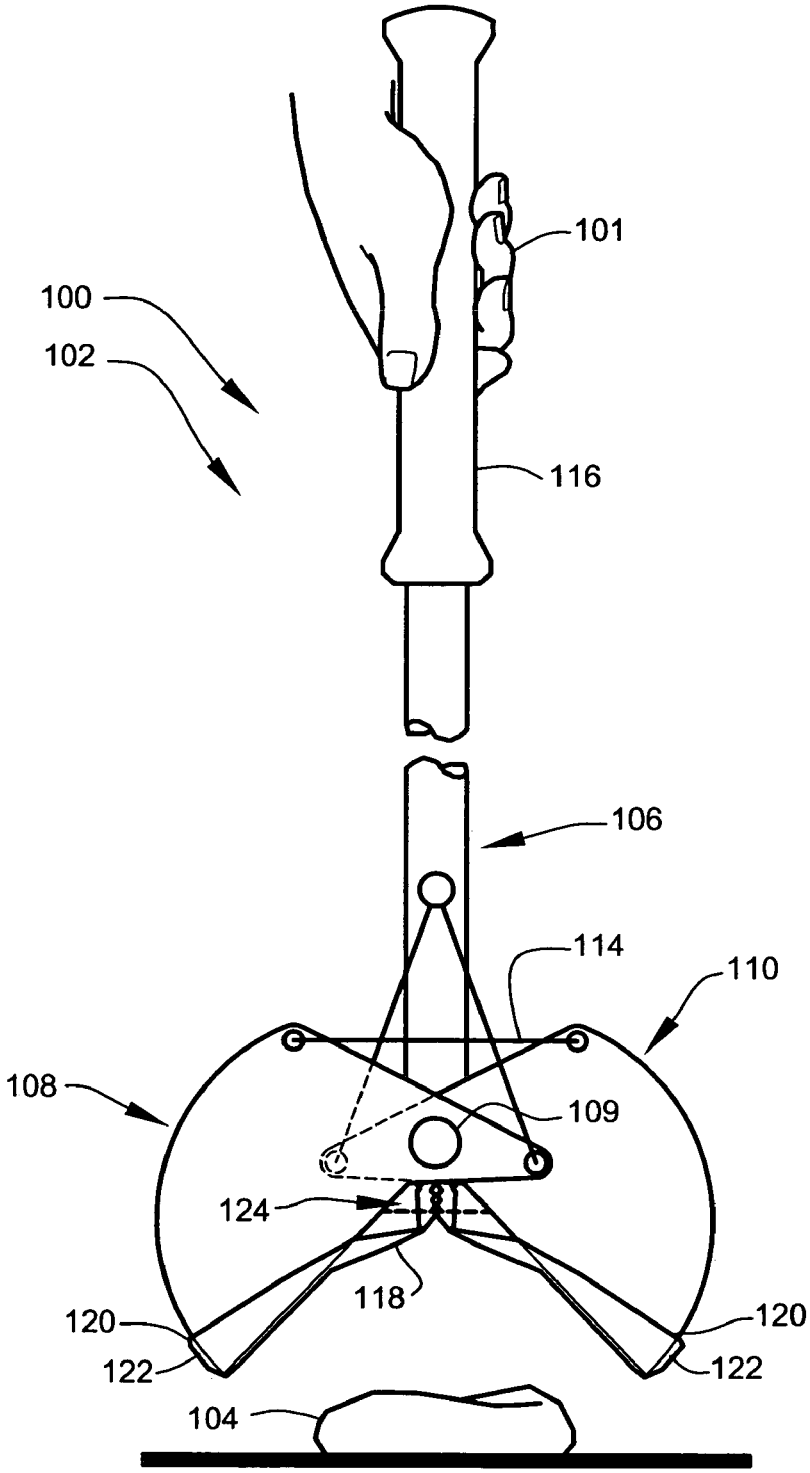
FIG. 1 shows a side view diagrammatically illustrating a pet-debris scooper of a pet-debris scooper system, according to a preferred embodiment of the present invention.

FIG. 1 shows a side view diagrammatically illustrating pet-debris scooper 102 of pet-debris scooper system 100, held in a position of use by the hand of user 101, according to a preferred embodiment of the present invention. Unless noted otherwise, in the present discussion, the terms "up" (upwardly) and "down" (downwardly) reference the position of the embodiment as depicted in the drawing figure to which the discussion is focused. In the present disclosure, the term "pet waste" refers to pet droppings (feces) but may include other pet waste materials including vomit or vector-carrying objects retrieved by the pet including vermin, etc.

Preferably, pet-debris scooper 102 comprises a device for picking up solid objects, such as pet debris and pet waste 104, and automatically sealing such pet waste 104 within a disposable liner. Preferably, pet-debris scooper 102 (at least embodying herein at least one grasper adapted to grasp the pet waste) comprises an elongated handle 106 supporting a pair of opposing scoops identified herein as scoop 108 and scoop 110, as shown. Preferably, scoop 108 and scoop 110 are movably joined to handle 106 by at least one pivoting coupler 109, as shown (at least embodying herein wherein such at least one first containment wall is movably positionable relative to such at least one second containment wall). Preferably, pivoting coupler 109 is adapted to allow the two scoops to articulate in a "clamshell-like" manner, as shown. When scoop 108 and scoop 110 are downwardly pivoted into an adjacent position, the two halves form a substantially enclosed container 112 (at least embodying herein wherein such at least one first containment wall and at least one second containment wall are together adapted to comprises at least one substantially enclosable interior portion). Preferably, scoop 108 and scoop 110 each comprise a generally concave inner surface, as shown. In the example embodiment of the present invention, scoop 108 and scoop 110 resemble half-cylinders. Upon reading the teachings of this specification, those of ordinary skill in the art will now understand that, under appropriate circumstances, considering such issues as intended use, cost, user preference, etc., other scoop shape arrangements, such as, for example, square, triangular, and similar geometric shapes, half-spheres, complex shapes including free-form surfaces, etc., may suffice.

Preferably, container 112 (see FIG. 2) is biased to the normally open position of FIG. 1, preferably by the application of spring tension or the application of a tension force by a similar tensioning mechanism, diagrammatically illustrated as biasing element 114, as shown. Biasing element 114 is illustrated by a single line of tension force applied to the upper portions of scoop 108 and scoop 110, as shown. Preferably, biasing element 114 is adapted to supply a tensioning force resulting in the upward pivoting of scoop 108 and scoop 110 about pivoting coupler 109, as shown. Upon reading the teachings of this specification, those of ordinary skill in the art will now understand that, under appropriate circumstances, considering such issues as intended use, design preference, etc., other biasing arrangements, such as, for example, biasing scoops to a normally closed position, etc., may suffice.

Preferably, handle 106 comprises an upper gripping-portion 116 adapted to assist user gripping of pet-debris scooper 102, during use, as described herein (at least embodying herein wherein such at least one grasper comprises at least one hand grip to assist hand gripping of such at least one grasper during such applying of the at least one liner to such at least one grasper and during such grasping of the pet waste by such at least one grasper). In addition, gripping-portion 116 preferably comprises at least one manually actuated control adapted to control the closing of scoop 108 and scoop 110. Preferred control arrangements are discussed further in FIG. 6A and FIG. 6B.

Figure 2:
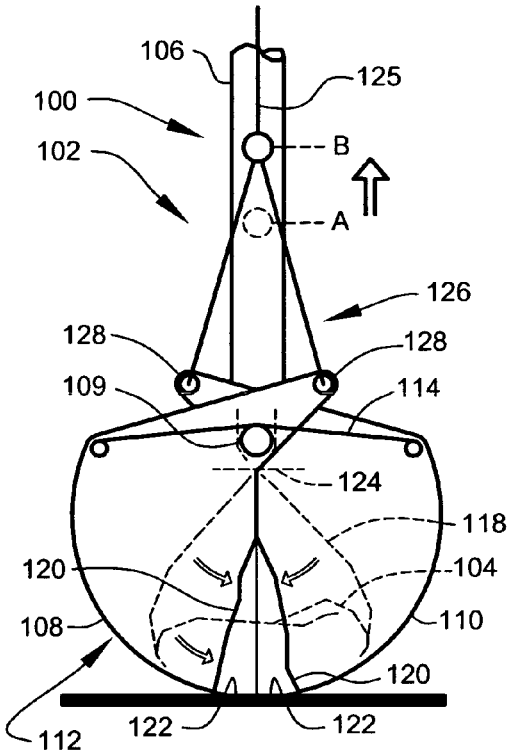
FIG. 2 shows a partial side view of the pet-debris scooper according to the preferred embodiment of FIG. 1 and further illustrates preferred methods of use.

Preferably, the interiors of scoop 108 and scoop 110 (at least embodying herein at least one first containment wall and at least one second containment wall) are preferably fitted with disposable liner 118 prior to use, as shown (at least embodying herein wherein such at least one substantially enclosable interior portion is adapted to receive at least one liner portion of such at least one liner). Preferably, disposable liners 118 are specifically designed for use with pet-debris scooper system 100 and are preferably constructed of lightweight and flexible material with a sheet plastic being most preferred. Preferably, disposable liner 118 is adapted to form a bag-like covering to surround and encapsulate pet waste 104 prior to disposal (as shown in FIG. 2). In addition, disposable liner 118 functions as a barrier to protect pet-debris scooper 102 from soiling by pet waste 104 during collection. Preferably, the peripheral ends of the liner are attached to the outside of scoop 108 and scoop 110, as shown. Most preferably, the peripheral edge 120 of disposable liner 118 comprises an adhesive strip 122 adapted to adhere the edge of disposable liner 118 to scoop 108 and scoop 110, most preferably to the external surfaces of scoop 108 and scoop 110, as shown (at least embodying herein wherein such at least one liner comprises at least one releasable adhesive adapted to releasably adhere the at least one liner to such at least one first containment wall and such at least one second containment wall). Preferably, disposable liner 118 is retained to the interior of container 112 by liner-clamping assembly 124, as shown (at least embodying herein wherein such at least one grasper further comprises at least one liner retainer adapted to retain such at least one liner portion of such at least one liner; and such at least one liner retainer is positioned substantially within such at least one substantially enclosable interior portion). The preferred arrangements and operation of liner-clamping assembly 124 are discussed in detail in FIG. 4 through FIG. 5D, below.

FIG. 2 shows a partial side view of pet-debris scooper 102 in a closed position according to the preferred embodiment of FIG. 1. Specific reference is now made to FIG. 2, with continued reference to FIG. 1. Preferably, to collect pet waste 104 for disposal, user 101 positions scoop 108 and scoop 110 over pet waste 104 and manipulates manually actuated control 126 to pivot scoop 108 and scoop 110 to a closed position, as shown. In the preferred embodiment of FIG. 1, manually actuated control 126 comprises a tensioning member 125 adapted to apply a pulling force to the lever arms 128 of scoop 108 and scoop 110, as shown. Preferably, application of such a tensional force (whereby tensioning member 125 is drawn upwardly from about reference position A to about reference position B) results the development of torque forces about the common fulcrum point located at pivoting coupler 109. When the developed torque exceeds the tensional force of biasing element 114, scoop 108 and scoop 110 rotate to enclose pet waste 104. Upon reading the teachings of this specification, those of ordinary skill in the art will now understand that, under appropriate circumstances, considering such issues as intended use, design preference, cost, etc., other arrangements adapted to form an essentially enclosed container, such as, for example, the use of multiple pivot points, hinges, tracks, guides, flexible or deformable scoops, etc., may suffice. It is noted that the configuration and operation of alternate pivoting clamshell arrangements, adaptable for use with the present invention, are described in greater detail in, for example, U.S. Pat. No. 5,601,321 to Simon, incorporated herein by reference for further examples of implementation engineering.

Preferably, closing scoop 108 and scoop 110 encapsulates pet waste 104 within the attached disposable liner 118, as shown. Preferably, disposable liner 118 comprises a self-sealing feature adapted to seal the material of disposable liner 118 along points of inter-contact, preferably along the lines of contact between scoop 108 and scoop 110, adjacent peripheral edges 120, as shown.

Figure 3:
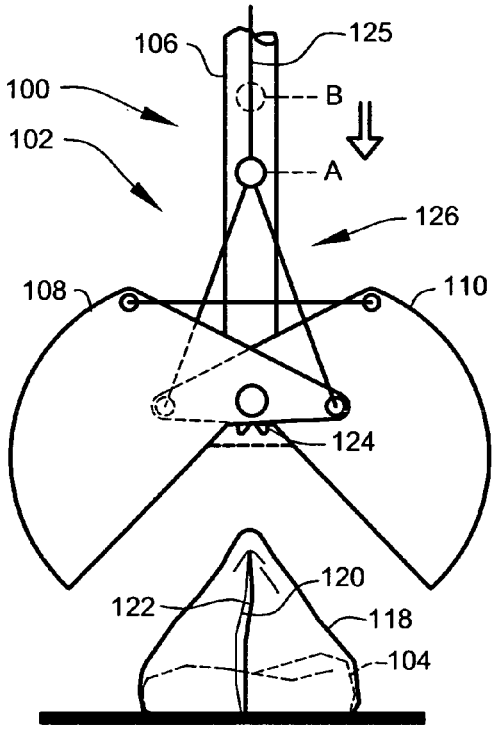
FIG. 3 shows a partial side view of the pet-debris scooper and continued illustration of the preferred methods of use.

FIG. 3 shows a partial side view of pet-debris scooper 102 and continued illustration of the preferred methods of use. Referring now to both FIG. 2 and FIG. 3, when pet-debris scooper 102 is closed, an operable control located in handle 106 draws a liner gripping portion of liner-clamping assembly 124 upward, releasing adhesive strips 122 from the external surfaces of the scoops, while pulling the attached disposable liner 118 into container 112, as shown. As peripheral edges 120 of disposable liner 118 are drawn between scoop 108 and scoop 110, the edges seal together forming a substantially closed liner, as shown (at least embodying herein wherein such at least one liner retainer comprises at least one puller adapted to pull such at least one liner into such at least one substantially enclosable interior portion; and such pulling of such at least one liner into such at least one substantially enclosable interior portion detaches such at least one liner from such at least one first containment wall and such at least one second containment wall). As disposable liner 118 (now substantially sealed) continues to be pulled further into container 112, disposable liner 118 is drawn against barrier 130. Preferably, barrier 130 pulls disposable liner 118 away from liner-clamping assembly 124, allowing disposable liner 118 to fall free from container 112 when scoop 108 and scoop 110 are opened, as shown (at least embodying herein at least one releaser adapted to release such at least one liner from such at least one liner retainer; and such at least one releaser is controlled by such pulling of such at least one liner by such at least one puller). Preferably, peripheral edges 120 of disposable liner 118 do not come in contact with pet waste 104 during the collection and encapsulation process, thus, there is no waste residue on the outside of disposable liner 118 after release. Once released, from the interior of container 112, the now-sealed disposable liner 118 is easily collected and removed for disposal. Pet-debris scooper 102, on discharging the sealed disposable liner 118, is ready for the fitting of a new disposable liner 118 (as described in FIG. 7A).

Preferably, disposable liner 118 comprises a self-sealing feature adapted to seal the material of disposable liner 118 along points of inter-contact, preferably along the lines of contact between scoop 108 and scoop 110, as shown (at least embodying herein wherein such at least one liner comprises at least one sealer structured and arranged to seal such at least one liner substantially around the pet waste; and wherein such at least one sealer is adapted to be assisted in such sealing of such at least one liner substantially around the pet waste by such pulling of such at least one liner into such at least one substantially enclosable interior portion). Preferred materials suitable for use in the fabrication of disposable liner 118 include self-sealing materials comprising flexible films coated with pressure sensitive adhesive for releasable seating to a target surface (in this case pet-debris scooper 102), and more particularly films which have features for preventing premature sticking to a target surface during storage and positioning of the film. Films suitable for use in fabrication of disposable liner 118 include materials produced by The Procter & Gamble Company of Cincinnati, Ohio utilizing a "Griptex-like" technology. It is noted that the structures and formulation of such films, adaptable for use with the present invention, are described in greater detail in, for example, U.S. Pat. No. 6,489,022 to Hamilton et al., incorporated herein by reference for further examples of implementation engineering. Alternate preferred sealing methodologies are presented in FIG. 8A and FIG. 8B below.

Figure 4:
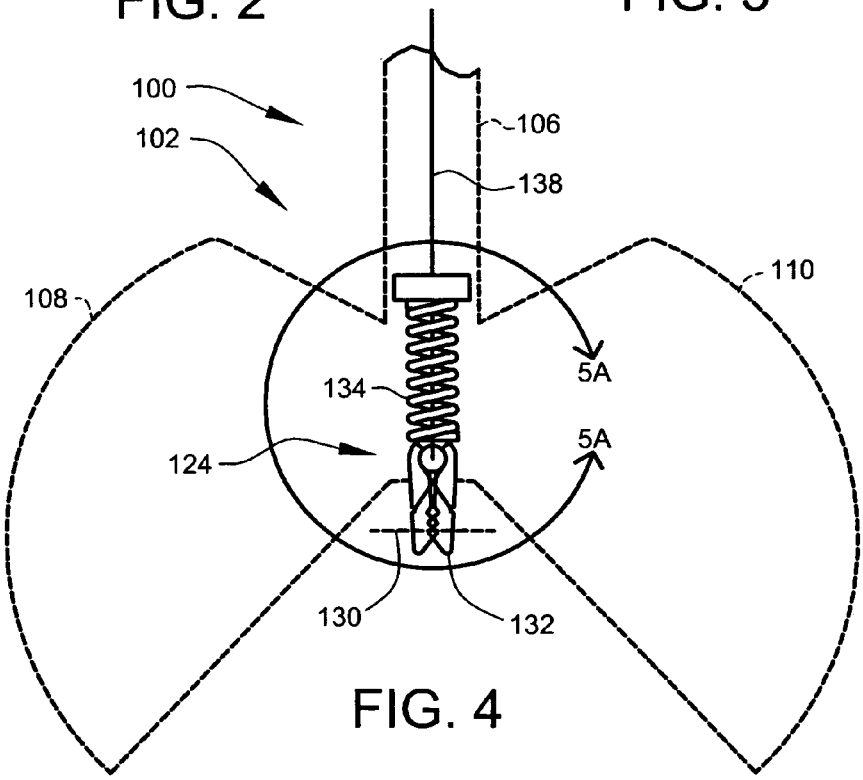
FIG. 4 shows a partial side view diagrammatically illustrating a liner-clamping assembly according to the preferred embodiment of FIG. 1.

FIG. 4 shows a partial side view diagrammatically illustrating the preferred arrangements of liner-clamping assembly 124 according to the preferred embodiment of FIG. 1. Preferably, liner-clamping assembly 124 comprises liner clamp 132, barrier 130 and spring 134, as shown. Preferably, liner-clamping assembly 124 is centrally mounted to the fixed (non-articulating) structures of pet-debris scooper 102. Preferably, spring 134 is adapted to maintain liner clamp 132 in a position of intersection with barrier 130, as shown. Preferably, liner clamp 132 is mounted to allow translational movement relative to barrier 130. Preferably, movement of liner clamp 132 is enabled by control rod 138 extending from within handle 106 to couple with liner clamp 132, as shown. Preferably, control rod 138 is adapted to draw liner clamp 132 upwardly through barrier 130 as described below.

Figure 5D:
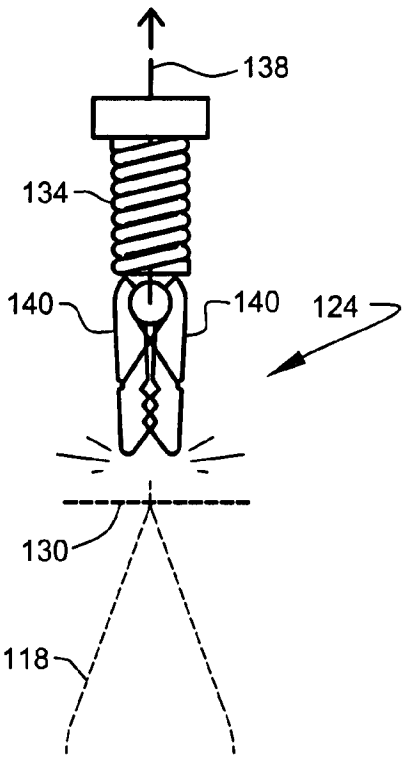
FIG. 5D shows the detail view of FIG. 5A with the disposable liner passing through a release barrier adapted to release the disposable liner from the liner-clamping assembly.
Figure 5C:
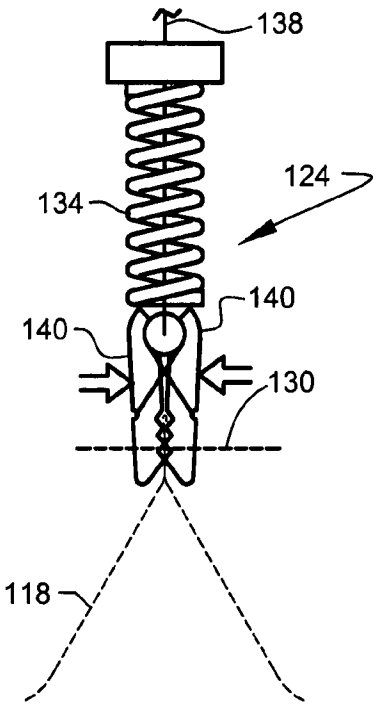
FIG. 5C shows the detail view of FIG. 5A with the liner-clamping assembly gripping the disposable liner of FIG. 5B.
Figure 5B:
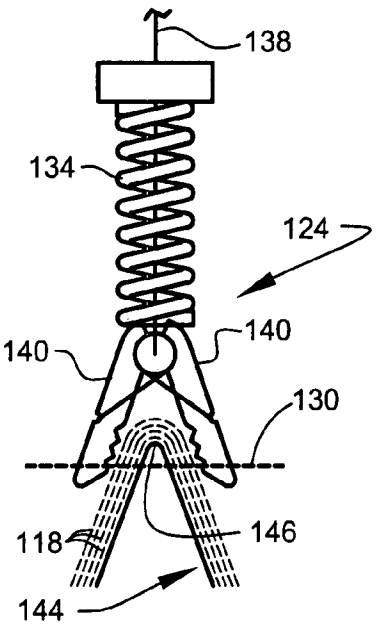
FIG. 5B shows the detail view of FIG. 5A with the liner-clamping assembly engaging a disposable liner of the pet-debris scooper system.
Figure 5A:
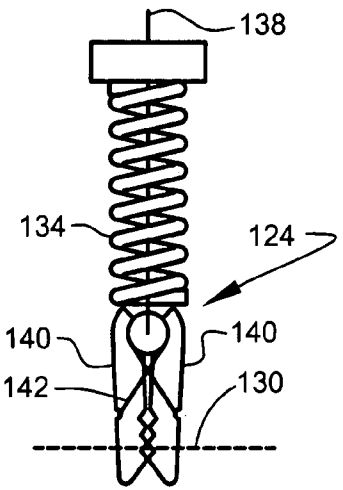
FIG. 5A shows the detail view 5A-5A of FIG. 4 generally illustrating the configuration of the liner-clamping assembly of FIG. 4.

FIG. 5A shows the detail view 5A-5A of FIG. 4 generally illustrating the configuration of liner-clamping assembly 124. FIG. 5A shows liner-clamping assembly 124 in a preferred resting position with the opposing jaws 140 of liner clamp 132 intersecting the line of barrier 130, as shown. Preferably, the opposing jaws 140 are held together by at least one opposing force, preferably supplied by clamp spring 142, as shown. Upon reading the teachings of this specification, those of ordinary skill in the art will now understand that, under appropriate circumstances, considering such issues as intended use, design preference, etc., other methods of applying an opposing force to the opposing jaws, such as, for example, a force applied by interaction with the barrier, etc., may suffice. Preferably, clamp spring 142 draws the two opposing jaws 140 shut, creating the action necessary for gripping disposable liner 118 (for clarity, it is helpful to visualize the configuration of a modified spring-type clothespin). Upon reading the teachings of this specification, those of ordinary skill in the art will now understand that, under appropriate circumstances, considering such issues as intended use, configuration of liner, etc., other liner clamping arrangements, such as, for example, adhesives, rollers, hook-and-loop-type temporary fasteners, etc., may suffice.

FIG. 5B shows the detail view of FIG. 5A depicting liner-clamping assembly 124 engaging disposable liner 118 of pet-debris scooper system 100. To connect disposable liner 118 to liner-clamping assembly 124, liner clamp 132 is lowered to engage a specially designed disposable-liner dispenser 144 (see FIG. 7A). Preferably, disposable-liner dispenser 144 is adapted to dispense a single disposable liner 118 from a stack of disposable liners 118, as shown. Pressing liner clamp 132 over clamp engaging point 146 of disposable-liner dispenser 144 results in the opening of the two opposing jaws 140 to situate the uppermost disposable liner 118 in a graspable position, as shown.

FIG. 5C shows the detail view of FIG. 5A with liner-clamping assembly 124 gripping the disposable liner 118 of FIG. 5B. Preferably, pulling liner clamp 132 away from clamp engaging point 146 allows the two opposing jaws 140 to shut, gripping disposable liner 118, as shown. Barrier 130 is preferably configured to accommodate the opening and closing of opposing jaws 140, as shown.

FIG. 5D shows the detail view of FIG. 5A with disposable liner 118 passing through release barrier 130 adapted to release disposable liner 118 from liner-clamping assembly 124. Preferably, control rod 138 is adapted to draw liner clamp 132 upwardly through barrier 130, as shown. Preferably, the preferred design of liner-clamping assembly 124 is such that barrier 130 allows the passage liner clamp 132 and resists the passage of disposable liner 118. Preferably, barrier 130 comprises one or more non-moving members that are preferably maintained in a substantially fixed positioning within container 112, as shown. As liner clamp 132 passes through barrier 130, disposable liner 118 is drawn against barrier 130, as shown. Preferably, as barrier 130 resists the passage of disposable liner 118, disposable liner 118 is pulled away from liner clamp 132, allowing disposable liner 118 to fall free. Preferably, to assist in removal, the upper portion of disposable liner 118 comprises a generally stiff physical structure (similar in consistency to the sealing portion of a zip-lock-type bag). Preferably, pulling disposable liner 118 past barrier 130 is sufficient to pull disposable liner 118 away from liner clamp 132. Upon reading the teachings of this specification, those of ordinary skill in the art will now understand that, under appropriate circumstances, considering such issues as design preference, cost, service, etc., other barrier configurations, such as, for example, the use of a movable barrier using one-way rollers that contact the liner and restrict upward liner movement while allowing free downward liner movement, in combination with low friction surfaces at the liner clamp, etc., may suffice.

Preferably, on releasing the tension from control rod 138, liner clamp 132 is returned to the resting position of FIG. 5A by a return force supplied by clamp spring 142, as shown.

Once barrier 130 has pulled disposable liner 118 away from liner-clamping assembly 124, disposable liner 118 is free to fall away from container 112 when scoop 108 and scoop 110 are opened. Preferably, peripheral edges 120 of disposable liner 118 do not come in contact with pet waste 104 during the collection and encapsulation process, thus, there is no waste residue on the outside of disposable liner 118 after release. Once released, from the interior of container 112, the now-sealed disposable liner 118 is easily collected and removed for disposal. Pet-debris scooper 102, on discharging the sealed disposable liner 118, is ready for the fitting of a new disposable liner 118 (as described in FIG. 7A).

Figure 6A:
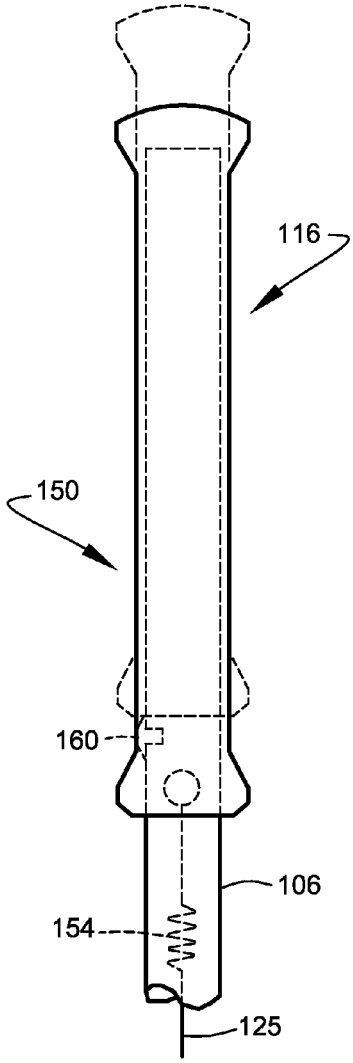
FIG. 6A shows a partial side view of a handgrip assembly of the pet-debris scooper of FIG. 1.
Figure 6B:
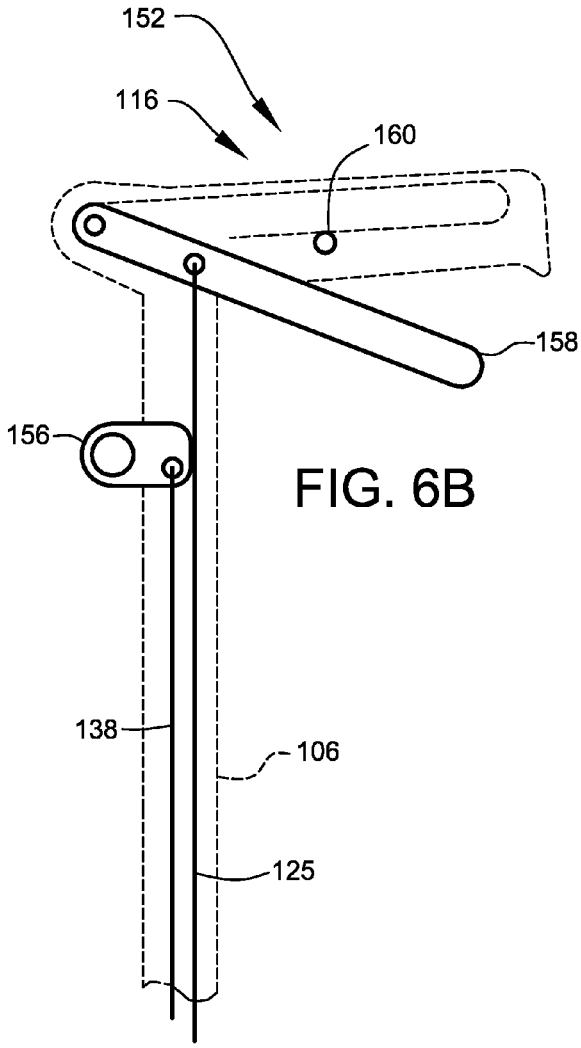
FIG. 6B shows a partial side view of an alternate handgrip assembly of the pet-debris scooper of FIG. 1.

FIG. 6A shows a partial side view of handle 106 depicting a preferred embodiment of gripping-portion 116 identified herein as handgrip assembly 150. FIG. 6B shows a partial side view of handle 106 depicting another preferred embodiment of gripping-portion 116 identified herein as handgrip assembly 152. In addition to providing a gripping surface for the manipulation of pet-debris scooper 102, gripping-portion 116 preferably comprises at least one manually actuated control adapted to control the closing of scoop 108 and scoop 110, as previously described. In the example depiction of FIG. 6A, handgrip assembly 150 comprises a sliding handle arrangement adapted to slide along handle 106, as shown. Preferably, tensioning member 125 is coupled to the moving portion of handgrip assembly 150, as shown. Preferably, the upward movement of handgrip assembly results in the upward movement of tensioning member 125 resulting in the closing of scoop 108 and scoop 110.

Furthermore, upon reading the teachings of this specification, those of ordinary skill in the art will now appreciate that, under appropriate circumstances, it is possible to develop preferred actuation arrangements that also function to engage (sequentially) control rod 138, thus enabling in a single movement, an uptake of liner clamp 132 following the closure of the scoops. These preferred in arrangements may preferably include the use of resilient members 154 at part of tensioning member 125, as shown.

Handgrip assembly 152 of FIG. 6B preferably comprises a pivoting trigger-type arrangement with a separate control 156 for operating liner-clamping assembly 124, as shown. Preferably, handgrip assembly 152 comprises pivoting member 158 couple to tensioning member 125, as shown. Preferably, hand squeezing pivoting member 158 induces a generally vertical movement in tensioning member 125.

Preferably, both handgrip assembly 150 and handgrip assembly 152 are adaptable to include at least one releasable retainer 160 adapted to retain tensioning member 125 in a position maintaining the closing of scoop 108 and scoop 110 (thus allowing users to release their grip while maintaining container 112 in a closed condition until arriving at a suitable disposal location). Upon reading the teachings of this specification, those of ordinary skill in the art will now understand that, under appropriate circumstances, considering such issues as user preference, intended use, etc., other gripping and control arrangements, such as twisting actuators, pneumatic controls, compression-based operators, additional ergonomic grips, the use of resilient padding, etc., may suffice.

FIG. 7A shows side view depicting disposable-liner dispenser 144 according to a preferred embodiment of the present invention. Preferably, disposable-liner dispenser 144 is adapted to apply, essentially automatically, a single disposable liner 118 to pet-debris scooper 102 by a simple press-and-release movement. A second important function of disposable-liner dispenser 144 is that of a holder to provide proper positioning and alignment of pet-debris scooper 102 within disposable-liner dispenser 144 during the application of a disposable liner 118. A third important function of disposable-liner dispenser 144 is that of a refillable holder to hold a plurality of disposable liners 118 (enabling multiple applications of a single liner). Yet another function of disposable-liner dispenser 144 is that of a holder providing convenient vertical storage of pet-debris scooper 102 between uses (at least embodying herein at least one holding component adapted to hold such at least one grasper; wherein such at least one holding component comprises at least one holder adapted to hold the at least one liner; wherein such at least one holding component further comprises at least one applicator adapted to apply the at least one liner to such at least one grasper).

Preferably, disposable-liner dispenser 144 is mechanically actuated without the use of electrically powered components. Upon reading the teachings of this specification, those of ordinary skill in the art will now understand that, under appropriate circumstances, considering such issues as intended use, cost, etc., other actuation arrangements, such as, for example, the use of electrically powered components, etc., may suffice. Preferably, disposable-liner dispenser 144 adapted to rest on a generally horizontal support surface, most preferably a floor surface, as shown. Upon reading the teachings of this specification, those of ordinary skill in the art will now understand that, under appropriate circumstances, considering such issues as intended use, size of unit, user preference, etc., other support arrangements, such as, for example, wall mounts, vehicle storage mounts, etc., may suffice.

FIG. 7B shows a diagrammatic sectional view depicting the internal functional components of disposable-liner dispenser 144. Preferably, a stacked arrangement of disposable liners 118 are mounted on a specially shaped applicator platform 160 located within disposable-liner dispenser 144, as shown. Preferably, applicator platform 160 comprises the clamp engaging point 146 described in FIG. 5B (at least embodying herein at least one positional director adapted to positionally direct such at least one liner to at least one retainable position adjacent such at least one liner retainer).

When pet-debris scooper 102 (without a liner attached), is placed onto disposable-liner dispenser 144, one disposable liner 118 attaches itself to scoop 108 and scoop 110 by means of adhesive strip 122 located along the peripheral edges 120 of disposable liner 118, as shown. At substantially the same time, engaging point 146 forces jaws 140 of liner clamp 132 apart, pushing disposable liner 118 into liner clamp 132 (when pet-debris scooper 102 is removed from disposable-liner dispenser 144, liner clamp 132 grabs and retains disposable liner 118 as described in FIG. 5C and FIG. 5D). Preferably, L-shaped pivoting members 162 are located on each side of applicator platform 160, as shown. Preferably, L-shaped pivoting members 162 are adapted to assist in pressing adhesive strip 122 to the external surfaces of the scoops (at least embodying herein wherein such at least one applicator is adapted to assist in adhering such at least one releasable adhesive of such at least one liner to such at least one first containment wall and such at least one second containment wall).

FIG. 7C shows the detail view 7C-7C of FIG. 7B illustrating adhesive strip 122 of peripheral edge 120. Preferably, the upper side of peripheral edge 120 comprises adhesive strip 122, as shown. Preferably, the opposite (lower) side of peripheral edge 120 comprises adhesive-resisting area 164, as shown. Preferably, adhesive-resisting area 164 comprises a surface resisting the adhesive quality of adhesive strip 122. This preferred arrangement prevents individual liners from adhering to each other while stored within disposable-liner dispenser 144, as shown. The above-described arrangements at least embody herein wherein such at least one liner further comprises at least one periphery comprising at least one first peripheral side and at least one second peripheral side; such at least one first peripheral side comprises such at least one releasable adhesive; such at least one second peripheral side comprises at least one adhesive resistor adapted to resist adherence of such at least one releasable adhesive; and at least one such at least one liner is stackable over at least one other such at least one liner without adherence between such at least one first peripheral side and such at least one second peripheral side.

Figure 7D:
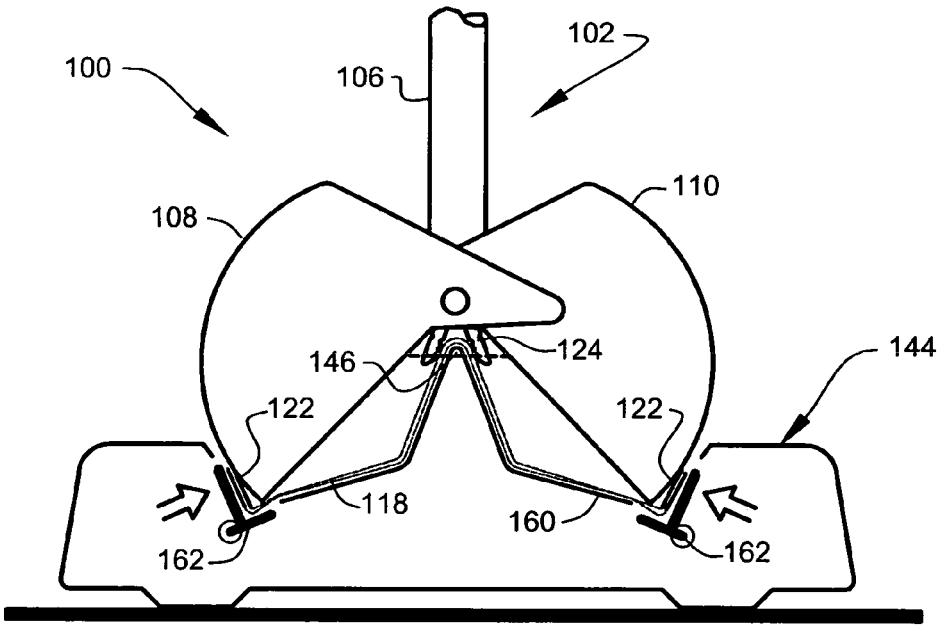
FIG. 7D shows a diagrammatic sectional view depicting the application of a disposable-liner to the pet-debris scooper of FIG. 1.

FIG. 7D shows a diagrammatic sectional view depicting the application of disposable-liner 118 to pet-debris scooper 102. FIG. 7D also depicts the preferred vertical storage position of pet-debris scooper 102 within disposable-liner dispenser 144.

Preferably, L-shaped pivoting members 162, which are mounted on the edge of applicator platform 160, pivot when pet-debris scooper 102 is lowered into contact, as shown. Preferably, the generally vertical legs of L-shaped pivoting members 162 rotate toward pet-debris scooper 102 to push the adhesive strips 122 of the disposable liner 118 (nearest to pet-debris scooper 102) onto the outer surfaces of scoop 108 and scoop 110, resulting in the attachment of the liner, as shown.

Figure 7E:
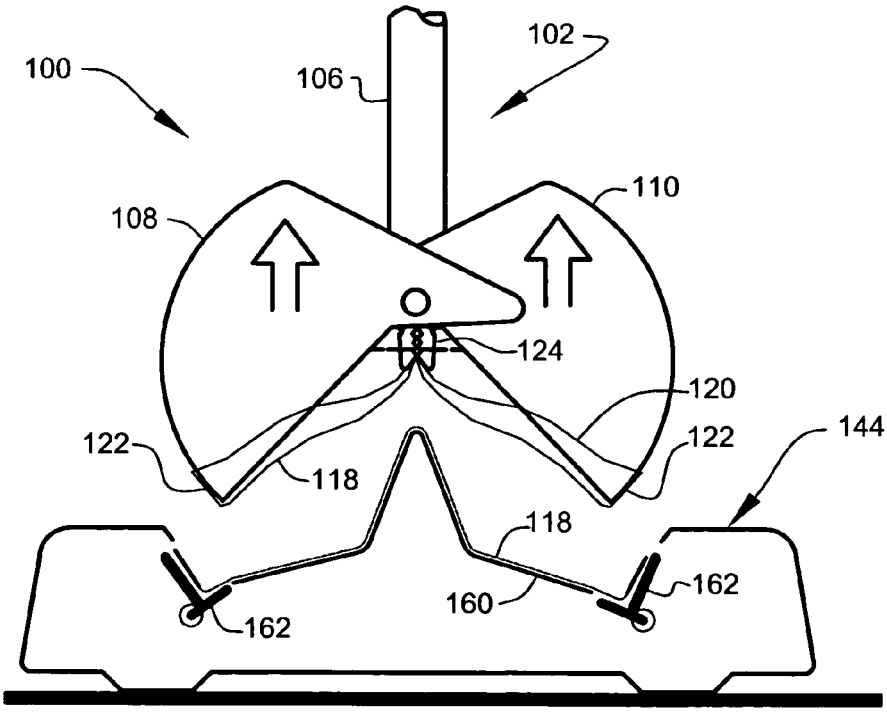
FIG. 7E shows a diagrammatic sectional view depicting the pet-debris scooper after application of the disposable-liner.

FIG. 7E shows a diagrammatic sectional view depicting the pet-debris scooper 102 after a preferred application of disposable-liner 118. Preferably, the periphery of disposable liner 118 is adhered to the outer surfaces of scoop 108 and scoop 110 while the middle of disposable-liner 118 is gripped by liner-clamping assembly 124, as shown.

Figure 8A:
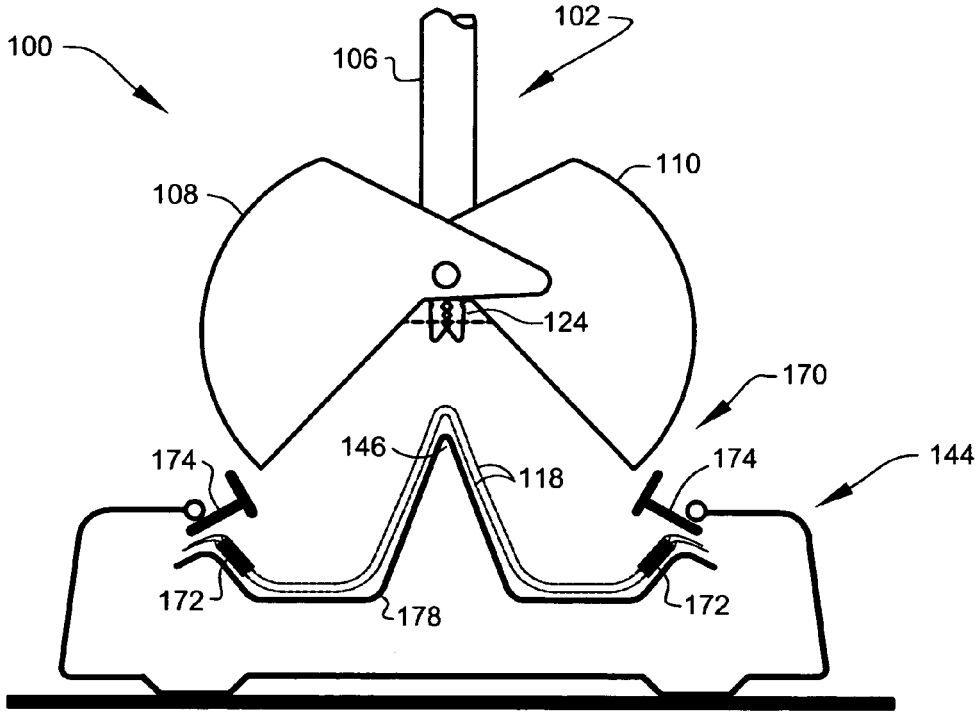
FIG. 8A shows a diagrammatic sectional view depicting the disposable-liner dispenser of FIG. 7A comprising an alternate internal component assembly according to a preferred embodiment of the present invention.
Figure 8B:
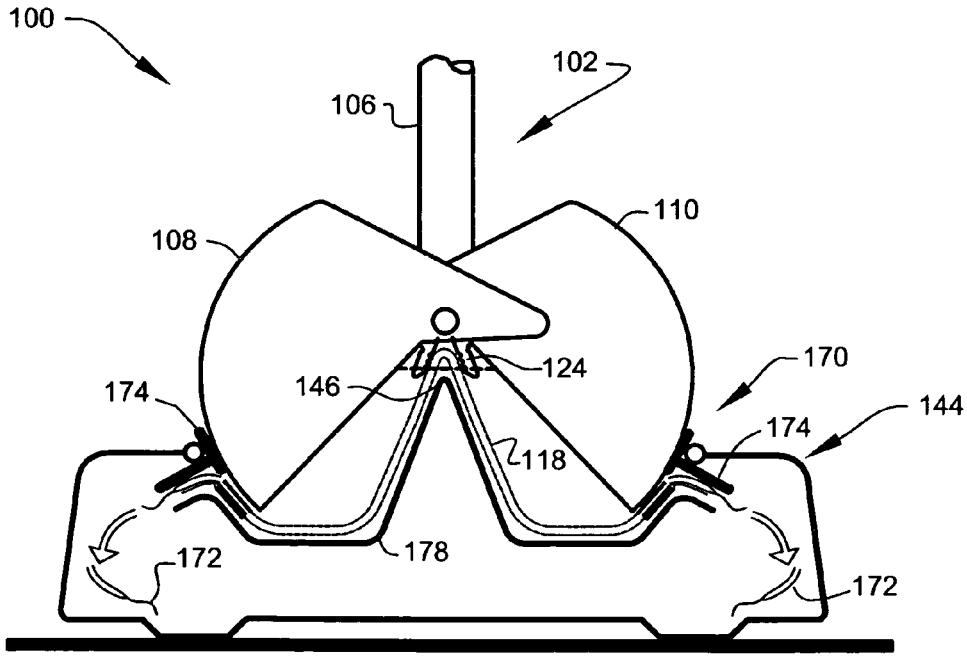
FIG. 8B shows a diagrammatic sectional view depicting the application of a disposable-liner to the pet-debris scooper using the alternate internal component assembly of 8A.

FIG. 8A shows a diagrammatic sectional view depicting the disposable-liner dispenser 144 of FIG. 7A comprising an alternate internal component assembly 170 according to another preferred embodiment of the present invention. FIG. 8B shows a diagrammatic sectional view depicting the application of a disposable-liner to the pet-debris scooper using the alternate internal component assembly 170 of 8A. Both FIG. 8A and FIG. 8B illustrate an alternate arrangement for the application and sealing of disposable liner 118.

In the present preferred embodiment, each side of peripheral edge 120 (of disposable liner 118) comprises an adhesive strip 122, as shown. Preferably, a removable protective strip 172 is applied over peripheral edges 120 to cover simultaneously both adhesive strips 122 during storage (at least embodying herein such at least one liner further comprises at least one removable cover adapted to removably cover such at least one releasable adhesive during storage). Preferably, alternate internal component assembly 170 comprises a set of T-shaped engagers 174 adapted to frictionally engage and remove the adhesive strips 122 as pet-debris scooper 102 is pressed downward into alternate internal component assembly 170 (at least embodying herein wherein such at least one applicator is adapted to remove such at least one removable cover prior to adherence of such at least one liner to such at least one first containment wall and such at least one second containment wall). Preferably, each T-shaped engager 174 is movably mounted within alternate internal component assembly 170, as shown. Preferably, downward contact by pet-debris scooper 102 on T-shaped engagers 174 moves the T-shaped engagers 174 in contact with the removable protective strips 172, as shown. When pet-debris scooper 102 is sufficiently engaged within alternate internal component assembly 170, protective strips 172 are pulled clear of disposable liner 118 to expose adhesive strips 122, as shown.

Preferably, the upper adhesive strips 122 functions to adhere disposable liner 118 to scoop 108 and scoop 110, as shown. The lower adhesive strips (located on the opposite side of peripheral edge 120) preferably function to seal together the peripheral edges 120 of disposable liner 118 on the closing of scoop 108 and scoop 110. Upon reading the teachings of this specification, those of ordinary skill in the art will now understand that, under appropriate circumstances, considering such issues as user preference, intended use, etc., the use of additional enabling features, such as one-way rollers, return springs, guide slots, resilient contact pads, etc., may suffice.

Preferably, alternate internal component assembly 170 also comprises a modified applicator platform 178, as shown. Preferably, applicator platform 178 comprises the clamp engaging point 146 described in FIG. 5B.

Figure 9:
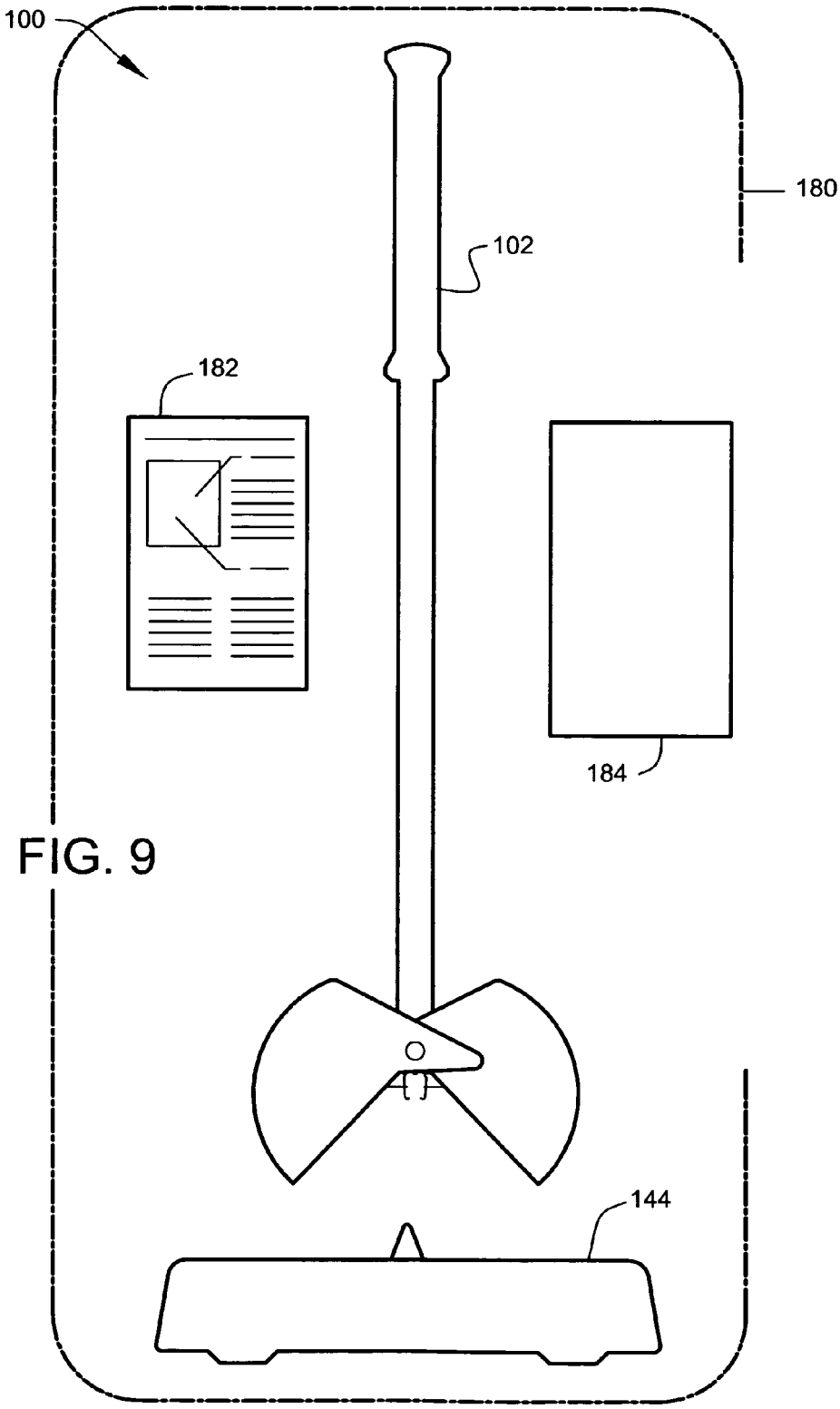
FIG. 9 shows a preferred kit system according to a preferred embodiment of the present invention.

FIG. 9 shows a preferred kit system 180 according to a preferred embodiment of the present invention. Preferred embodiments of pet-debris scooper system 100 are adaptable to comprise a consumer kit. Preferably, such a kit is offered containing the basic elements needed to use and operate pet-debris scooper system 100.

Preferably, kit system 180 comprises pet-debris scooper 102, disposable-liner dispenser 144, and instructions for use 182, as shown. In addition, preferred embodiments of kit system 180 comprise at least one disposable liner 118, most preferably a package 184 comprising a plurality of disposable liners 118, as shown.

Upon reading the teachings of this specification, those of ordinary skill in the art will now understand that, under appropriate circumstances, considering such issues as user preference, intended use, etc., other kit arrangements, such as including consumer packaging, instructions comprising video media, accessories such a portable liner applicator, kids comprising advertising indicia or indicia tied to a specific pet breed, etc., may suffice.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A method related to the collection of at least one pet waste item using at least one hand-holdable grasper comprising the steps of:

a) providing at least one disposable liner adapted to resist the passage of the pet waste;

b) providing at least one applicator adapted to apply such at least one disposable liner to such at least one hand-holdable grasper;

c) loading at least one first at least one disposable liner onto such at least one applicator;

d) loading such at least one hand-holdable grasper onto such at least one applicator, wherein such at least one first at least one disposable liner becomes attached to such at least one hand-holdable grasper; and e) removing from such at least one applicator, such at least one hand-holdable grasper comprising such at least one first at least one disposable liner.

2. The method according to claim 1 further comprising the step of grasping the at least one pet waste item with such at least one hand-holdable grasper comprising such at least one first at least one disposable liner, wherein such at least one first at least one disposable liner substantially encapsulates the at least one pet waste item.

3. The method according to claim 1 further comprising the step of releasing such at least one first at least one disposable liner from such at least one hand-holdable grasper, wherein such at least one first at least one disposable liner substantially encapsulates the at least one pet waste item.

4. The method according to claim 1 further comprising the step of loading such at least one hand-holdable grasper onto such at least one applicator, wherein at least one second at least one disposable liner is attached to such at least one hand-holdable grasper.

5. A system related to the collection and encapsulation of pet waste within at least one liner comprising at least one membrane substantially impermeable to the pet waste, said system comprising:

a) at least one grasper adapted to grasp the pet waste;

b) at least one holding component adapted to hold said at least one grasper;

c) wherein said at least one holding component comprises at least one holder adapted to hold the at least one liner;

d) wherein said at least one holding component further comprises at least one applicator adapted to apply the at least one liner to said at least one grasper; and e) wherein said at least one grasper comprises at least one hand grip to assist hand gripping of said at least one grasper during such applying of the at least one liner to said at least one grasper and during such grasping of the pet waste by said at least one grasper.

6. The system according to claim 5 further comprising:

a) such at least one liner;

b) wherein said at least one liner comprises at least one membrane substantially impermeable to the pet waste; and c) wherein said at least one membrane is substantially flexible.

7. The system according to claim 6 wherein:

a) said at least one grasper comprises at least one container adapted to contain the pet waste;

b) said at least one container comprises at least one first containment wall and at least one second containment wall;

c) said at least one first containment wall is movably positionable relative to said at least one second containment wall;

d) said at least one first containment wall and at least one second containment wall are together adapted to comprises at least one substantially enclosable interior portion; and e) said at least one substantially enclosable interior portion is adapted to receive at least one liner portion of said at least one liner.

8. The system according to claim 7 wherein:

a) said at least one liner comprises at least one releasable adhesive adapted to releasably adhere the at least one liner to said at least one first containment wall and said at least one second containment wall; and b) said at least one applicator is adapted to assist in adhering said at least one releasable adhesive of said at least one liner to said at least one first containment wall and to said at least one second containment wall.

9. The system according to claim 8 wherein:

a) said at least one grasper further comprises at least one liner retainer adapted to retain said at least one liner portion of said at least one liner; and b) said at least one liner retainer is positioned substantially within said at least one substantially enclosable interior portion.

10. The waste collection system, according to claim 9 wherein:

a) said at least one liner retainer comprises at least one puller adapted to pull said at least one liner into said at least one substantially enclosable interior portion; and b) such pulling of said at least one liner into said at least one substantially enclosable interior portion detaches said at least one liner from said at least one first containment wall and said at least one second containment wall.

11. The system, according to claim 10 wherein:

a) said at least one liner comprises at least one sealer structured and arranged to seal said at least one liner substantially around the pet waste; and b) wherein said at least one sealer is adapted to be assisted in such sealing of said at least one liner substantially around the pet waste by such pulling of said at least one liner into said at least one substantially enclosable interior portion.

12. The system, according to claim 11 wherein said at least one sealer comprises at least one contact adhesive.

13. The system, according to claim 11 wherein said at least one sealer comprises at least one self-sealing material comprising at least one flexible film coated with at least one pressure sensitive adhesive adapted to self-seal by at least one application of mechanical pressure.

14. The system according to claim 11 further comprising:

a) at least one releaser adapted to release said at least one liner from said at least one liner retainer; and b) said at least one releaser is controlled by such pulling of said at least one liner by said at least one puller.

15. The system according to claim 11 wherein:

a) said at least one hand grip comprises at least one elongated handle adapted to support said at least one first containment wall and said at least one second containment wall;

b) said at least one first containment wall and said at least one second containment wall each comprise at least one generally scoop-shaped member; and c) at least one of said at least one generally scoop-shaped member comprises at least one pivoting coupler adapted to movably join at least one of said at least one generally scoop-shaped members to said at least one elongated handle.

16. The system according to claim 15 wherein said at least one substantially enclosable interior portion of said at least one container is formable by the positioning of at least one of said at least one generally scoop-shaped members adjacent at least one other said at least one generally scoop-shaped members.

17. The system according to claim 9 wherein said at least one applicator further comprises at least one positional director adapted to positionally direct said at least one liner to at least one retainable position adjacent said at least one liner retainer.

18. The system according to claim 8 wherein:

a) said at least one liner further comprises at least one removable cover adapted to removably cover said at least one releasable adhesive during storage; and b) said at least one applicator is adapted to remove said at least one removable cover prior to adherence of said at least one liner to said at least one first containment wall and said at least one second containment wall.

19. The system according to claim 8 wherein:

a) said at least one liner further comprises at least one periphery comprising at least one first peripheral side and at least one second peripheral side;

b) said at least one first peripheral side comprises said at least one releasable adhesive;

c) said at least one second peripheral side comprises at least one adhesive resistor adapted to resist adherence of said at least one releasable adhesive; and d) at least one said at least one liner is stackable over at least one other said at least one liner without adherence between said at least one first peripheral side and said at least one second peripheral side.

20. A kit system related to the collection and encapsulation of pet waste within, said system comprising:

a) at least one grasper adapted to grasp the pet waste i) wherein said at least one grasper comprises at least one hand grip to assist hand gripping of said at least one grasper during such grasping of the pet waste by said at least one grasper;

b) at least one holding component adapted to hold said at least one grasper i) wherein said at least one holding component comprises at least one holder adapted to hold at least one liner, and ii) wherein said at least one holding component further comprises at least one applicator adapted to apply at least one liner to said at least one grasper;

c) at least one set of user instructions for use; and d) at least one liner comprising at least one membrane substantially impermeable to the pet waste.

* * * * *